United States Patent [19]

Hicks et al.

[11] 3,997,995

[45] Dec. 21, 1976

[54] SALUTING ROUND ADAPTER

[75] Inventors: Elmer L. Hicks, Lanham, Md.; Robert L. Scheler, Anchorage; Douglas E. Slayton, Louisville, both of Ky.

[73] Assignee: The United States of America as represented by the Secretary of the Navy, Washington, D.C.

[22] Filed: Jan. 19, 1976

[21] Appl. No.: 650,107

[52] U.S. Cl. ..... 42/77; 102/41

[51] Int. Cl.[2] ..... F41C 21/10

[58] Field of Search ..... 42/77, 1 R; 89/14, 16; 102/41

[56] References Cited

UNITED STATES PATENTS

| | | | |
|---|---|---|---|
| 271,883 | 2/1883 | Martin | 42/77 |
| 1,804,986 | 5/1931 | Holden et al. | 102/41 |
| 2,107,034 | 2/1938 | Guthrie | 42/77 |
| 2,352,476 | 6/1944 | French | 42/77 |
| 2,902,933 | 9/1959 | Moldofsky et al. | 102/41 |

FOREIGN PATENTS OR APPLICATIONS

| | | | |
|---|---|---|---|
| 218,108 | 3/1942 | Switzerland | 102/41 |

*Primary Examiner*—Charles T. Jordan
*Attorney, Agent, or Firm*—R. S. Sciascia; Paul S. Collignon

[57] ABSTRACT

An adapter for firing a small caliber round in a large caliber gun. A cartridge case which fits a large caliber gun is provided with an internal thread for receiving an adapter sleeve. The adapter sleeve has a bore for receiving a small caliber round and is provided with a locking device for holding a small caliber round in position.

4 Claims, 5 Drawing Figures

SALUTING ROUND ADAPTER

BACKGROUND OF THE INVENTION

The present invention relates to an adapter that permits small, relatively inexpensive, ammunition to be fired in a large weapon, such as a 3 inch/50 gun.

Various modification devices have been made for use on guns so that they may be used for purposes other than for which they were designed. For example, in U.S. Pat. No. 3,690,026, entitled, "Extension Barrel For Use In Firing Projectiles With Firearm Using Blank Cartridges", which issued Sept. 12, 1972, to Larry A. Rose, there is disclosed an auxiliary barrel which can be attached to the muzzle end of a firearm so that projectiles such as tranquilizer darts, tear gas projectiles and the like can be fired by using blank cartridges.

In U.S. Pat. No. 3,802,108, entitled "Smooth Bore Gun Adapter", which issued Apr. 9, 1974, to Robert Mainhardt and Gary G. Niskala, another adapter for a weapon, such as a shot gun, is shown, which attaches to the barrel of a weapon to reduce effectiveness so that the weapon is not lethal.

SUMMARY OF THE INVENTION

The present invention relates to an adapter which permits small caliber ammunition to be fired in a large caliber gun for saluting purposes.

An empty cartridge case which fits a large caliber gun is modified and provided with an internal thread so that a sleeve can be threadedly attached within the cartridge case. The sleeve is provided with a bore to receive a small caliber round and a locking device is provided to hold a small caliber round in position.

It is therefore a general object of the present invention to provide an adapter so that a small, relatively inexpensive saluting round can be fired in a large caliber gun.

Other objects, advantages and novel features of the present invention will become apparent from the following detailed description of the invention when considered in conjunction with the accompanying drawing.

DESCRIPTION OF THE PREFERRED EMBODIMENT

Figure 1:
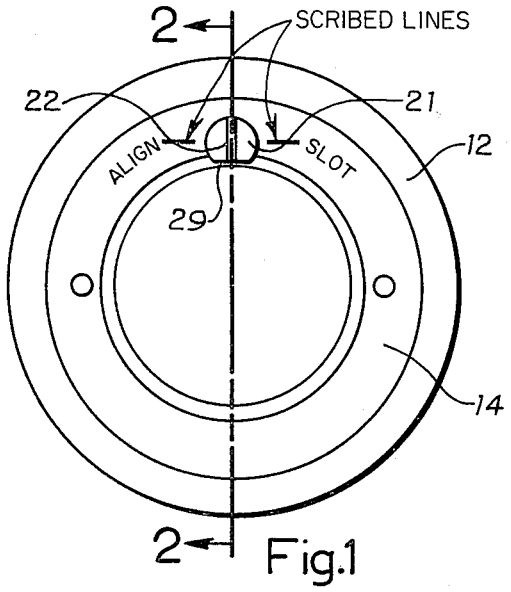
FIG. 1 is an end view of a preferred embodiment of the present invention.
Figure 2:
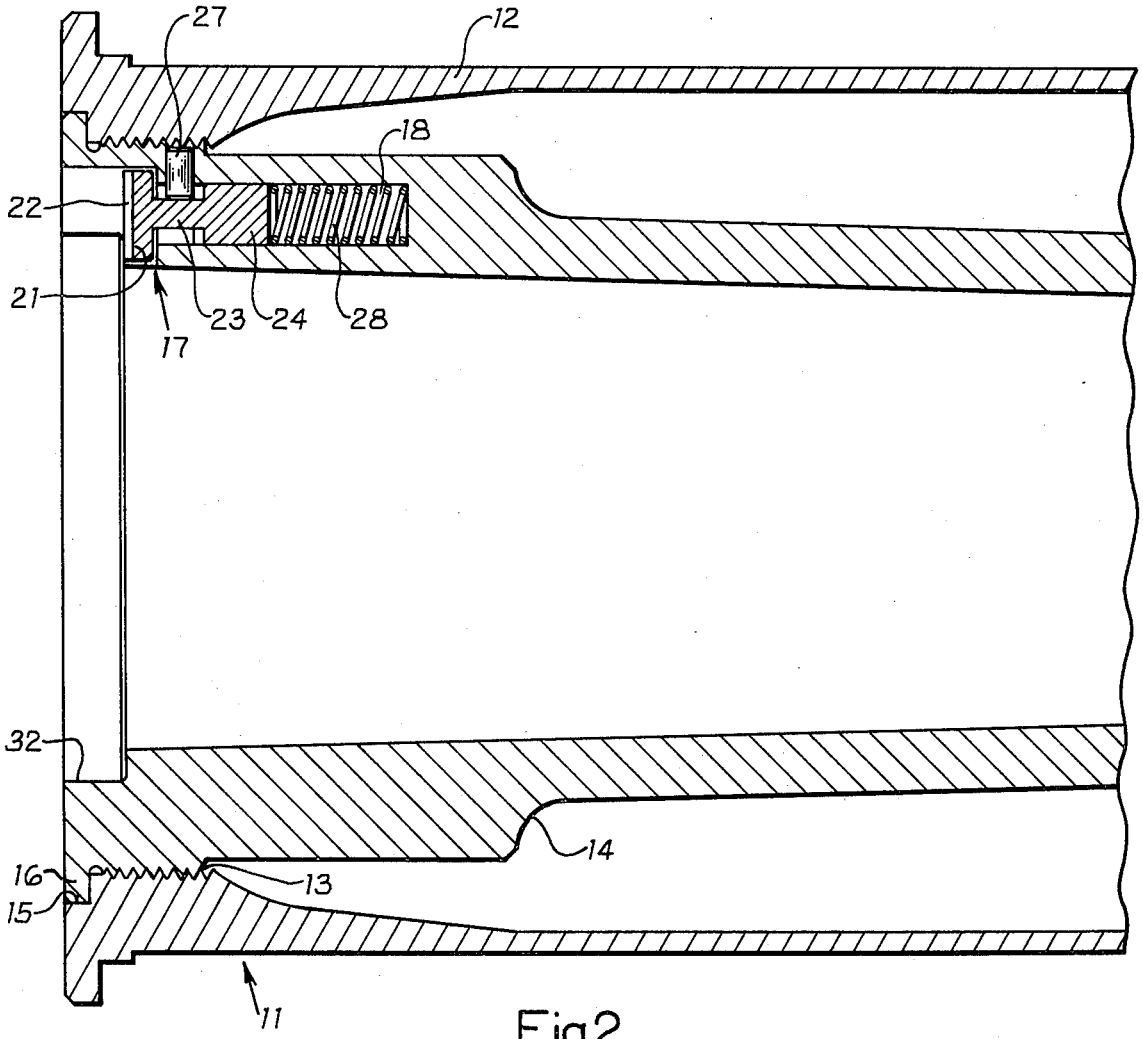
FIG. 2 is a sectional view taken on line 2—2 of FIG. 1.

Referring now to the drawings, there is shown a saluting round adapter 11 comprised of a standard cartridge case 12 having an outside diameter designed to fit into the breech of a large gun, such as a 3 inch/50 Naval gun. An internal thread 13 is cut in case 12 so that a sleeve 14 can be threadedly attached within case 12. Case 12 is also provided with a counterbore 15 so that a lip 16 on sleeve 14 can be seated flush with the front of cartridge case 12.

A retaining pin 17 is provided in bore 18 of sleeve 14 to lock a cartridge 19 with sleeve 14. Retaining pin 17 is comprised of a head 21 having a slot 22 therein, a reduced diameter portion 23 and a body portion 24. Body portion 24 is provided with a pair of opposed slots 25 and 26 which are sufficiently deep so that their bottom surface is on a level with the reduced diameter portion 23. A pin 27 is pressed-fitted in sleeve 14 and extends into bore 18. Retaining pin 17 is positioned so that the reduced diameter portion 23 is opposed pin 27 so that pin 27 retains retaining pin 17 within bore 18. A spring 28 is positioned within bore 18 and biases retaining pin 17 outwardly from bore 18, however, pin 27 prevents removal of retaining pin 17 from bore 18. It can be seen that retaining pin 17 can be rotated when pin 27 is opposite reduced diameter portion 23, however when pin 27 extends into either slot 25 or 26 rotation is prevented and retaining pin 17 is locked. Head 21 is provided with a flat portion 29 that provides clearance so that a blank cartridge 19 can be inserted into the bore of sleeve 14.

OPERATION

Prior to inserting a blank cartridge 19 into sleeve 14, retaining pin 17 must be rotated so that flat portion 29 is horizontal, as shown in FIG. 1 of the drawing, thereby permitting clearance into the bore of sleeve 14. In the event that flat portion 29 is not horizontal to permit access to the bore of sleeve 14, a tool, such as a screwdriver, is inserted into slot 22 of head 21 and an axial force is applied thereby moving retaining pin 17 inwardly and compressing spring 28. After retaining pin 17 moves inwardly at least a distance equal to the diameter of pin 27, pin 27 is cleared from either slot 25 or slot 26 and retaining pin 27 is free to rotate so that the flat portion can be moved to a horizontal position to permit clearance into the bore of sleeve 14.

Figure 3:
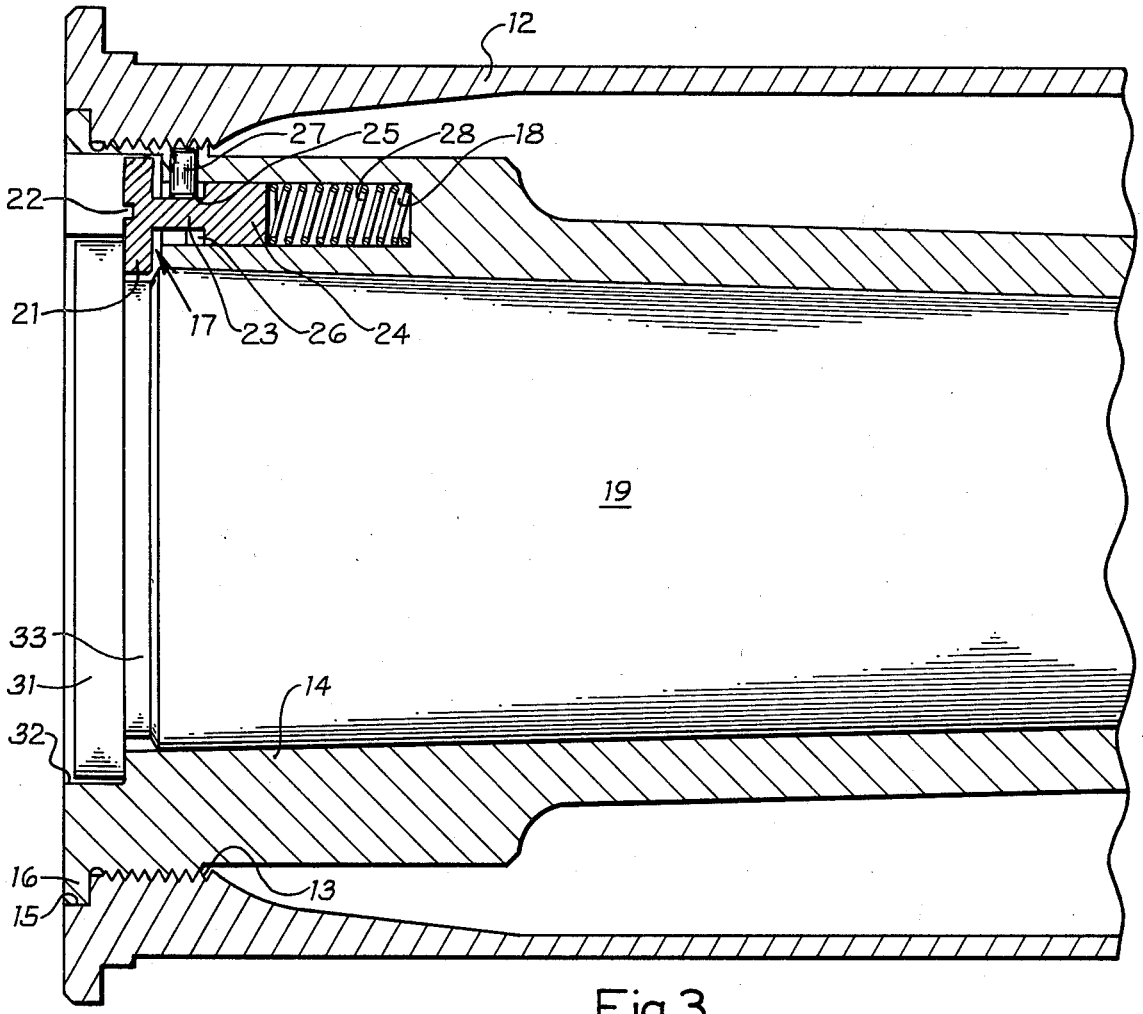
FIG. 3 is a view similar to FIG. 2, only showing a cartridge in position.
Figure 4:
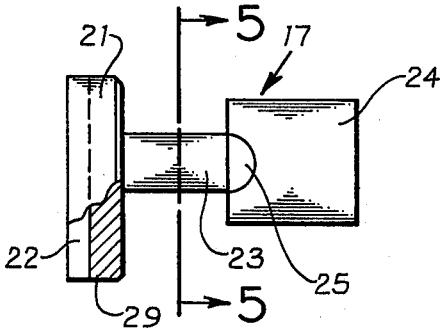
FIG. 4 is a top view of a cartridge retaining pin.
Figure 5:
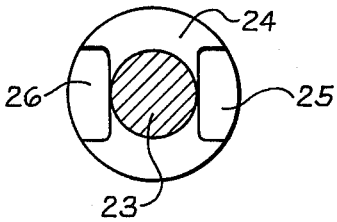
FIG. 5 is a sectional view taken on line 5—5 of FIG. 4.

A cartridge 19, such by way of example as a 40 mm blank, is inserted into sleeve 14 so that the cartridge rim 31 is fully seated in bore 32 of sleeve 14. A tool, such as a screwdriver, is then inserted into slot 22 and retaining pin 17 is pushed inwardly and then rotated ninety degrees so that slot 22 becomes aligned with the two scribed lines on the front face of sleeve 14, as shown in FIG. 1 of the drawing. When head 21 is rotated, head 21 becomes engaged in groove 33 of cartridge 19 and prevents removal of cartridge 19 from sleeve 14. As best shown in FIG. 3 of the drawing, when the tool is removed, a portion of head 21 is engaged in slot 33 of cartridge 19, and spring 18 moves retaining pin 17 outwardly so that pin 27 is partially engaged in slot 25 of retaining pin 17 and retaining pin 17 cannot be rotated.

When it is desired to remove cartridge 19 from sleeve 14, such as after firing, retaining pin 17 must first be moved inwardly until pin 27 clears slot 25. Retaining pin 25 is then rotated ninety degrees so that head 21 clears slot 33 of cartridge 19 and cartridge 19 can be withdrawn from sleeve 14.

It can be seen that the present invention permits small, relative, inexpensive blank ammunition to be used as saluting rounds in large guns, such as a 3 inch/50 Naval gun, at a substantial cost savings.

Obviously many modifications and variations of the present invention are possible in the light of the above teachings. It is therefore to be understood that within the scope of the appended claims the invention may be practiced otherwise than as specifically described.

We claim:

1. A saluting round adapter for firing small caliber blank ammunition in a larger caliber gun comprising, a cartridge case having outside dimensions suitable for seating in a large caliber gun, a sleeve positioned within said cartridge case and having inner dimensions suitable for seating small caliber ammuntion, and a retaining pin rotatably mounted in said sleeve and having a head thereon engageable with the rim of a cartridge to be locked in said sleeve.

2. A saluting round adapter for firing small caliber blank ammunition in a larger caliber gun as set forth in claim 1 wherein said sleeve is threadedly attached to said cartridge case.

3. A saluting round adapter for firing small caliber blank ammunition in a larger caliber gun as set forth in claim 1 wherein means are provided for locking said retaining pin from rotation thereby preventing removal of a small caliber cartridge positioned in said sleeve.

4. A saluting round adapter for firing small caliber blank ammunition in a larger caliber gun as set forth in claim 1 wherein said head on said retaining pin has a flat portion thereon for permitting access of a cartridge into said sleeve.

* * * * *